US011524853B2

(12) United States Patent
Liu

(10) Patent No.: US 11,524,853 B2
(45) Date of Patent: Dec. 13, 2022

(54) DEVICE FOR SEPARATING PRINTING PAPER SHEETS AND PRINTER

(71) Applicant: XIAMEN HANIN ELECTRONIC TECHNOLOGY CO., LTD., Xiamen (CN)

(72) Inventor: Zhiping Liu, Xiamen (CN)

( * ) Notice: Subject to any disclaimer, the term of this patent is extended or adjusted under 35 U.S.C. 154(b) by 323 days.

(21) Appl. No.: 16/867,713

(22) Filed: May 6, 2020

(65) Prior Publication Data

US 2021/0094774 A1 Apr. 1, 2021

(30) Foreign Application Priority Data

Sep. 30, 2019 (CN) ..... 201910944513.0

(51) Int. Cl.
*B65H 3/54* (2006.01)
*B65H 1/26* (2006.01)

(52) U.S. Cl.
CPC ..... *B65H 1/263* (2013.01); *B65H 2405/313* (2013.01)

(58) Field of Classification Search
CPC .. B65H 1/263; B65H 2405/313; B65H 3/523; B65H 3/54; B65H 3/5276; B65H 2405/1113; B65H 2405/1131; B65H 2405/11141; B65H 1/06; B65H 1/10; B65H 3/042; B65H 3/063
See application file for complete search history.

(56) References Cited

U.S. PATENT DOCUMENTS 3,627,307 A * 12/1971 Van Der Does ..... G03B 27/586 271/14
3,871,642 A * 3/1975 Mariaux ..... B65H 3/56 271/99
4,674,737 A * 6/1987 Murayoshi ..... B65H 3/46 271/124
6,367,795 B1 * 4/2002 Matsuda ..... B65H 3/5238 271/121
2009/0309293 A1 * 12/2009 Hung ..... B65H 3/52 271/21

* cited by examiner

*Primary Examiner* — Thomas A Morrison
(74) *Attorney, Agent, or Firm* — The Law Office Of Austin Bonderer, PC; Austin Bonderer

(57) ABSTRACT

A device for separating printing paper sheets comprises a base part and an obstruction element. The base part defines a printing paper accommodating cavity. A deforming mechanism is provided to make sure a middle part of the printing paper sheets can be arched and two edges can get close to the bottom of the printing paper accommodating cavity. The obstruction element is arranged with a middle access portion in cooperation with the deforming mechanism, and on two sides of the middle access portion is arranged with blocking portions through which only one printing paper sheet can pass at a time. The device for separating printing paper sheets makes more than one printing paper sheet that may be transmitted at a time during the transmission of the printing paper sheets. A printer achieves smooth transmission of printing paper sheets and alleviates problems such as downtime and failure of the printer.

13 Claims, 8 Drawing Sheets

DEVICE FOR SEPARATING PRINTING PAPER SHEETS AND PRINTER

CROSS-REFERENCE TO RELATED APPLICATIONS

The present application claims the benefit under 35 U.S.C. § 119 of China Patent Application No. 201910944513.0, filed on Sep. 30, 2019, in the China National Intellectual Property Administration, the content of which is hereby incorporated by reference.

FIELD OF THE INVENTION

The present disclosure relates to the technical field of printers, more particularly to a device for separating printing paper sheets and a printer.

BACKGROUND OF THE INVENTION

The printers usually pick up the printing paper sheets one by one to perform printing, and it is necessary to make sure that one and only one Imprinted paper sheet can be fed from the paper deck to the printer at a time. Conventional separation devices separate and feed the paper by various friction forces between the pick-up roller, the printing paper sheets, and the friction plate, and they can prevent two or more printing paper sheets from entering into the printer at a time. However, since the friction forces between the printing paper sheets are not constant, for example when an attraction between printing paper sheets occur due to moisture, two or more printing paper sheets may be fed to the printer at a time and result in downtime caused by abnormal feeding operation of the printer. In case of low relative humidity, an attraction also may occur due to the static electricity generated between printing paper sheets. In such a case, the existing pick-up rollers and friction plates can hardly separate the printing paper sheets, and similarly, several paper sheets may be fed to the printer at a time. Also, the friction force generated between a paper which is dry and pick-up rollers and friction plates may be reduced, which may result in a failure of feeding during the rotation of the pick-up roller.

SUMMARY OF THE INVENTION

The present disclosure provides a device for separating printing paper sheets and a printer, which can solve the problem that more than one printing paper sheet may be transmitted at a time.

To this end, the present disclosure provides a device for separating printing paper sheets, which comprises a base part and an obstruction element. The base part is provided with a printing paper accommodating cavity. A deforming mechanism is further provided such that a middle part of the printing paper sheets can be arched and two edges of the printing paper sheets can get close to the bottom of the printing paper accommodating cavity. The obstruction element is arranged with a middle access portion in cooperation with the deforming mechanism, and on two sides of the middle access portion is arranged with at least one blocking portion, through which only one printing paper sheet can pass at a time.

In some embodiments, the deforming mechanism comprises a supporting portion protruding upwardly from the bottom of the printing paper accommodating cavity. Thus, the middle part of the printing paper sheets can be arched.

And a pressing portion is configured to press down two edges of the printing paper sheets. Thus, the two edges of the printing paper sheets can get close to the printing paper accommodating cavity.

In some embodiments, the bottom of the printing paper accommodating cavity is arranged at a middle portion of a front end with a pick-up roller. The pick-up roller protrudes upwardly from the bottom of the printing paper accommodating cavity. The supporting portion is arranged on the pick-up roller.

In some embodiments, the pick-up roller can be driven by a driving device to feed the printing paper sheets frontward.

In some embodiments, a pressing element is further provided, and the pressing portion is arranged at two sides of a front end of the pressing element to enable the sides of the printing paper sheets to get close to the bottom of the printing paper accommodating cavity.

In some embodiments, the deforming mechanism comprises two position limiting walls and a pressing element in cooperation with the two-position limiting walls to press the printing paper sheets towards the bottom of the printing paper accommodating cavity, and the two walls are arranged in parallel and spaced at a distance less than a width of one paper sheet.

In some embodiments, a leading angle in an arch-like shape is formed on the middle access portion at a side of the obstruction element adjacent to the printing paper accommodating cavity, wherein the leading angle fits with the printing paper sheet having arched middle part.

In some embodiments, the blocking portions are provided at both sides of the obstruction element, and two avoidance portions are provided at both ends of the obstruction element. Between the middle access portion and each one of the avoidance portions are provided with the blocking portion.

The present disclosure also provides a printer. The printer comprises a housing and the device for separating printing paper sheets mentioned above.

In some embodiments, between the pressing element and the housing, an elastic element for pressing printing paper sheets towards the printing paper accommodating cavity is arranged.

The technical solution of the present disclosure has advantages as follows.

1. Due to the deforming mechanism in the present disclosure, the middle part of the printing paper sheets can be arched, and it is easy to pick up the lowest arched printing paper sheet. In such a case, the attraction between the printing paper sheets can be reduced, which facilitates the transmission of a single printing paper sheet. Due to the obstruction element arranged with the blocking portion through which only one paper sheet can pass at a time, it assures that only one printing paper sheet can be fed to the printer at a time, thereby solving the problem that more than one printing paper sheet may be transmitted at a time.

2. Between the pressing element and the housing, the elastic element for pressing the printing paper sheets disposed in the printing paper accommodating cavity is arranged. Thus, the friction force for transmitting the printing paper sheets can be increased. It avoids a failure of feeding during the rotation of the pick-up roller caused by insufficient friction force of the pick-up roller, and reduces failure rates of the printer.

DETAILED DESCRIPTION OF ILLUSTRATED EMBODIMENTS

In order to make the purpose, technical solution and advantages of embodiments of the present disclosure more clear, the embodiments of the present disclosure will be described more completely and clearly below in conjunction with the accompanying drawings illustrating the embodiments. It is apparent that the embodiments described below are merely some, but not all, embodiments of the present disclosure. Based on the embodiments of the present disclosure, those skilled in the art may obtain other embodiments included within the scope of the present disclosure without any creative work. Therefore, the detailed description of embodiments of the present disclosure illustrated in the accompanying drawings is not intended to limit the scope of the disclosure, but rather illustrates particular embodiments of the present disclosure. Based on the embodiments of the present disclosure, those skilled in the art may obtain other embodiments included within the scope of the present disclosure without any creative work.

Figure 1:
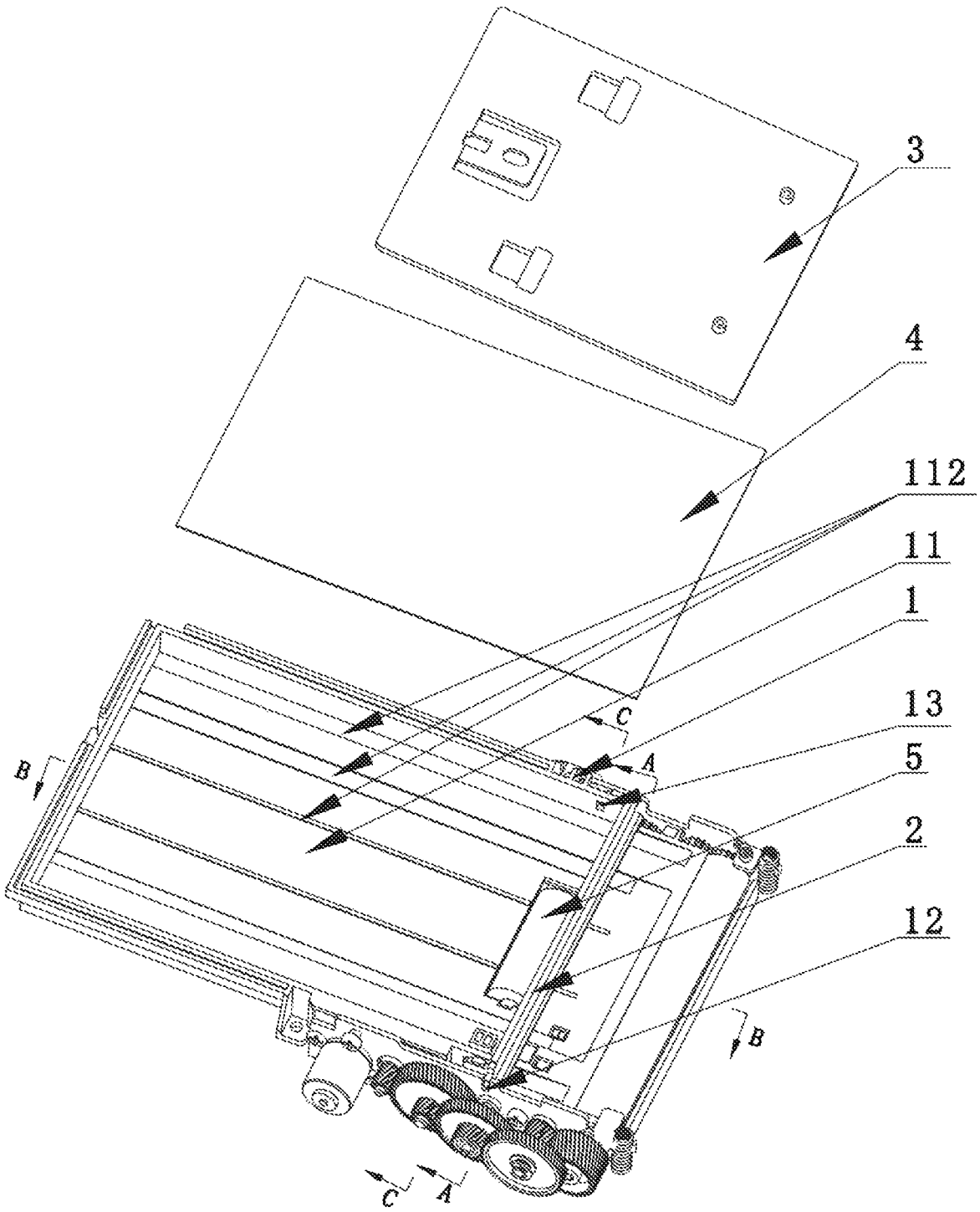
FIG. 1 is an exploded view according to the present disclosure.
Figure 2:
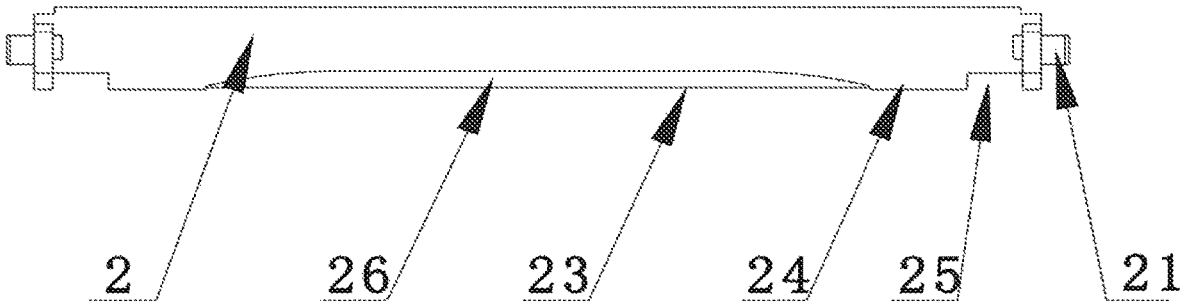
FIG. 2 and FIG. 3 are schematic views illustrating an obstruction element according to the present disclosure from different perspectives.
Figure 3:
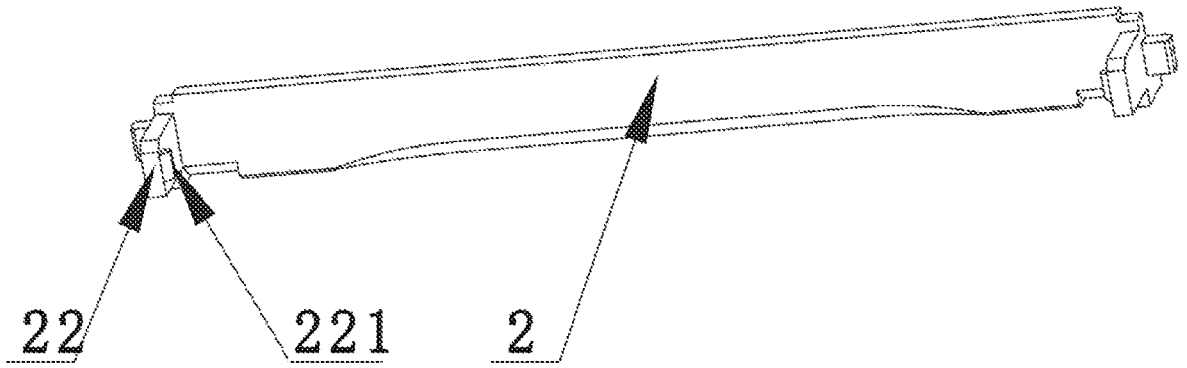
Figure 4:
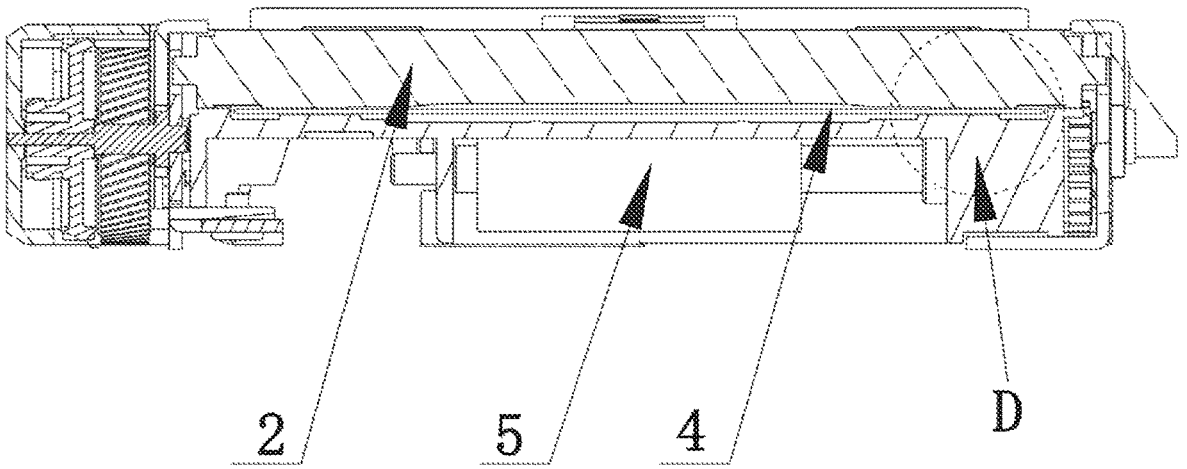
FIG. 4 is a cross-sectional view taken along a line A-A shown in FIG. 1.
Figure 5:
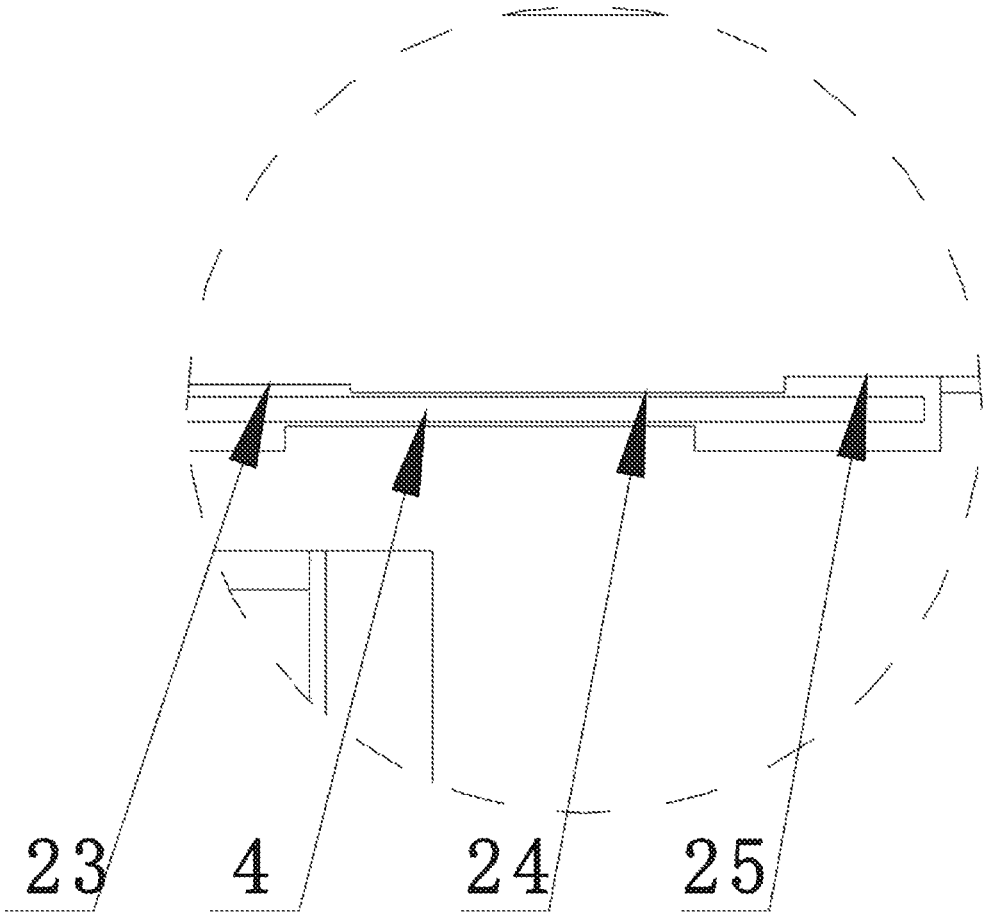
FIG. 5 is an enlarged view schematically showing a part D of FIG. 4.
Figure 6:
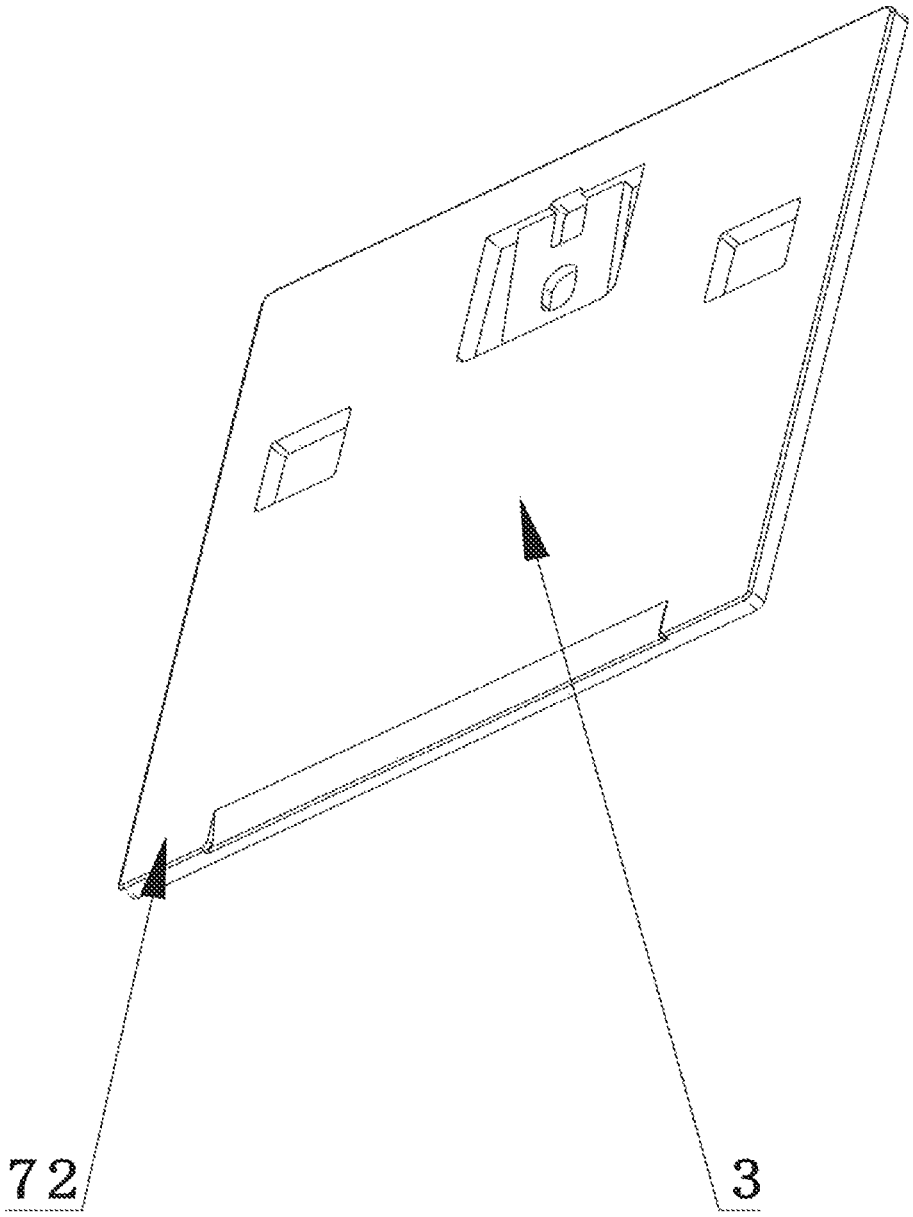
FIG. 6 is a schematic view illustrating a supporting portion and a pressing portion of the present disclosure.
Figure 7:
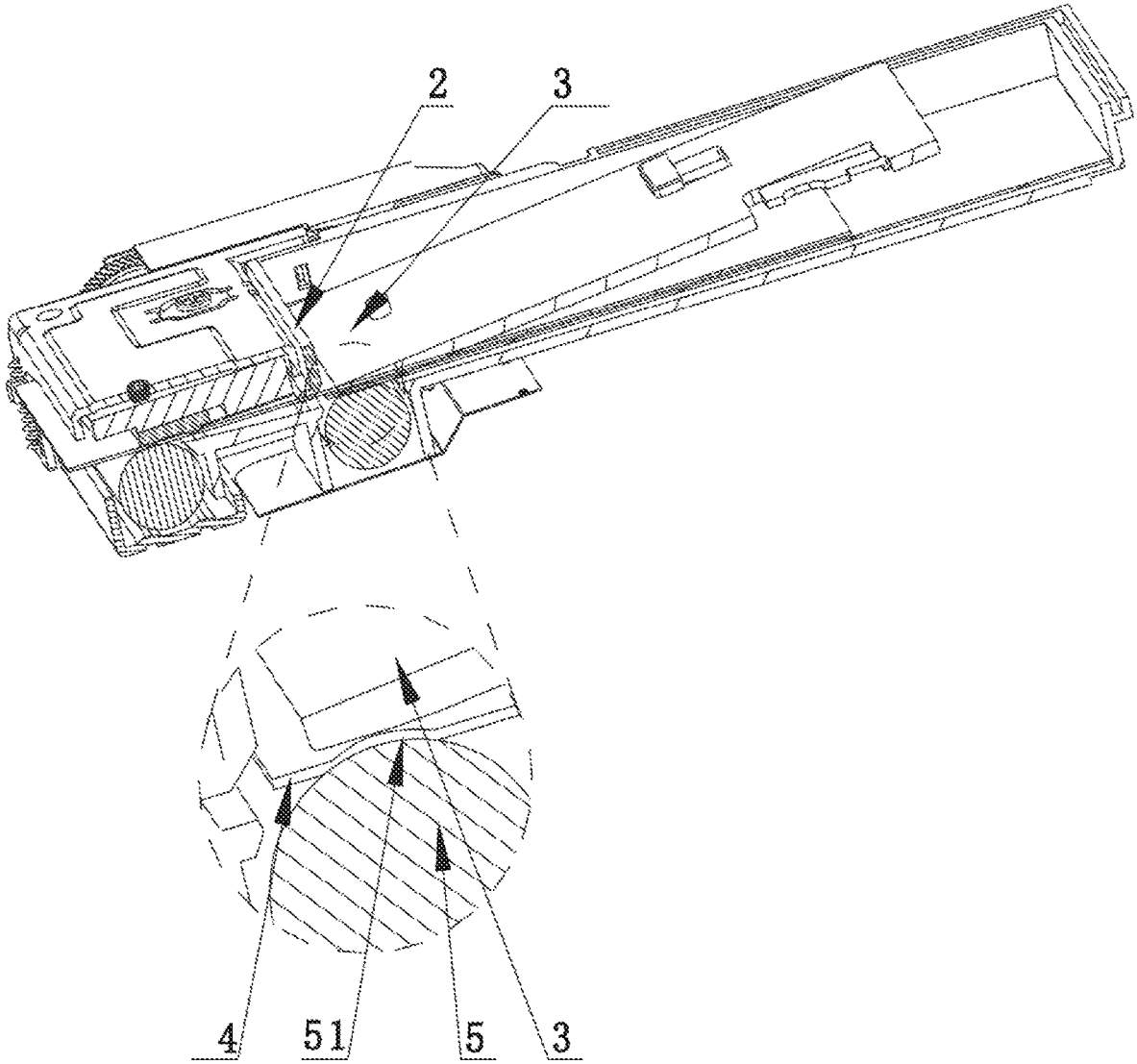
FIG. 7 is a cross-sectional view taken along a line B-B shown in FIG. 1.

Referring to FIG. 1, a device for separating printing paper sheets in a first embodiment of the present disclosure comprises a base part 1, a printing paper accommodating cavity 11, a pick-up roller 5, an obstruction element 2, a deforming mechanism, and a pressing element 3. The base part 1 defines the printing paper accommodating cavity 11 configured for accommodating the printing paper sheets 4. The pick-up roller 5 protrudes upwardly from a bottom 111 of the printing paper accommodating cavity and capable of feeding the printing paper sheets 4 frontward. The obstruction element 2 configured to allow one printing paper sheet 4 to pass through. The deforming mechanism is configured to press the printing paper sheets 4 in such a manner that a middle part of the printing paper sheets 4 is arched. The pressing element 3 is configured to press the pressing portion 72 located at two sides of the deforming mechanism in such a manner that two edges of the printing paper sheets 4 abut against the bottom 111 of the printing paper accommodating cavity.

Referring to FIGS. 1-5, the obstruction element 2, which has a substantially elongated structure. The obstruction element 2 is arranged at left and right sides with lengthened supporting plates 21. The lengthened supporting plates 21 can be engaged with the grooves 12 of the base part 1 and are configured to restrain frontward and rearward movements of the obstruction element 2. The obstruction element 2 is further arranged at two ends with extending portions 22 extending frontward. Herein, the extending portions 22 are respectively arranged with a fixing element 221, which can be engaged with the opening 13 provided on the sidewall of the printing paper accommodating cavity 11 in order to fix the obstruction element 2 on the base part 1. Further, the obstruction element 2 is provided at its bottom portion with a middle access portion 23, two blocking portions 24 and two avoidance portions 25. The middle access portion 23 is located in the middle of the bottom portion. The two avoidance portions 25 are located at two end portions of the bottom portion. The two blocking portions 24 are located between the middle access portion 23 and the two avoidance portions 25. The two blocking portions 24 protrude more than the middle access portion 23, and the two avoidance portions 25. A gap through which the printing paper sheets 4 can pass is formed between the bottom portion of the obstruction element 2 and the bottom 111 of the printing paper accommodating cavity. In particular, referring to FIG. 4, the obstruction element 2 is configured for separating the stack of printing paper sheets 4 to be transmitted from the printing paper accommodating cavity 11. In order to improve the printing effect, the printer picks up the printing paper sheets one by one to perform printing. By controlling the gap formed between the obstruction element 2 and the printing paper accommodating cavity 11, the stack of printing paper sheets 4 can be separated. In the case that only the lowest one of the printing paper sheets 4 can pass through the gap formed between the blocking portions 24 of the obstruction element 2 and the printing paper accommodating cavity 11, and two printing paper sheets 4 cannot pass through the gap at a time, it assures that only one printing paper sheet 4 can be fed to the printer at a time. Assuming the printing paper sheets 4 has a thickness L, the gap formed between the blocking portions 24 of the obstruction element 2 and the printing paper accommodating cavity 11 may be in a range of L-2L, preferably 1.5L. In such a case, it assures that the gap is sufficient to allow the lowest one sheet to pass through at a time, and meanwhile, the gap is not sufficient to allow two printing paper sheets 4 to pass through at a time. The printing paper sheets 4 may be produced to have a different thickness in a certain range. For example, the printing paper sheets 4 may have a thickness in a range of 0.3 mm-0.5 mm and thus two printing paper sheets 4 may have a thickness in a range of 0.6 mm-1 mm. In such a case, the gap may be provided in the range of 0.5 mm-0.6 mm, preferably 0.55 mm, and only one printing paper sheet 4 can pass through the gap in the above-mentioned range.

Referring to FIGS. 1, 6, 7 and 8, the bottom 111 of the printing paper accommodating cavity is arranged at the middle portion of the front end with the pick-up roller 5. The pick-up roller 5 protrudes upwardly from the bottom 111 of the printing paper accommodating cavity and can be driven by a driving device to feed the printing paper sheets 4 frontward. In order to achieve frontward feeding of the stack of printing paper sheets 4 and facilitate the separation, a deforming mechanism for the printing paper sheets 4 is provided. The deforming mechanism is configured to press the printing paper sheets 4 in such a manner that the middle part of the printing paper sheets 4 is arched and two edges of the printing paper sheets 4 tightly abut against the bottom 111 of the printing paper accommodating cavity. In the case that the middle part of the stack of printing paper sheets 4 is arched, the attraction will not occur, and the lowest printing paper sheet 4 can be easily picked up. Also, the printing paper sheets 4 abutting at two edges can be transmitted to pass through the obstruction element 2, and the arched printing paper sheet 4 will not abut on the obstruction element 2 to result in a failure of feeding.

Figure 8:
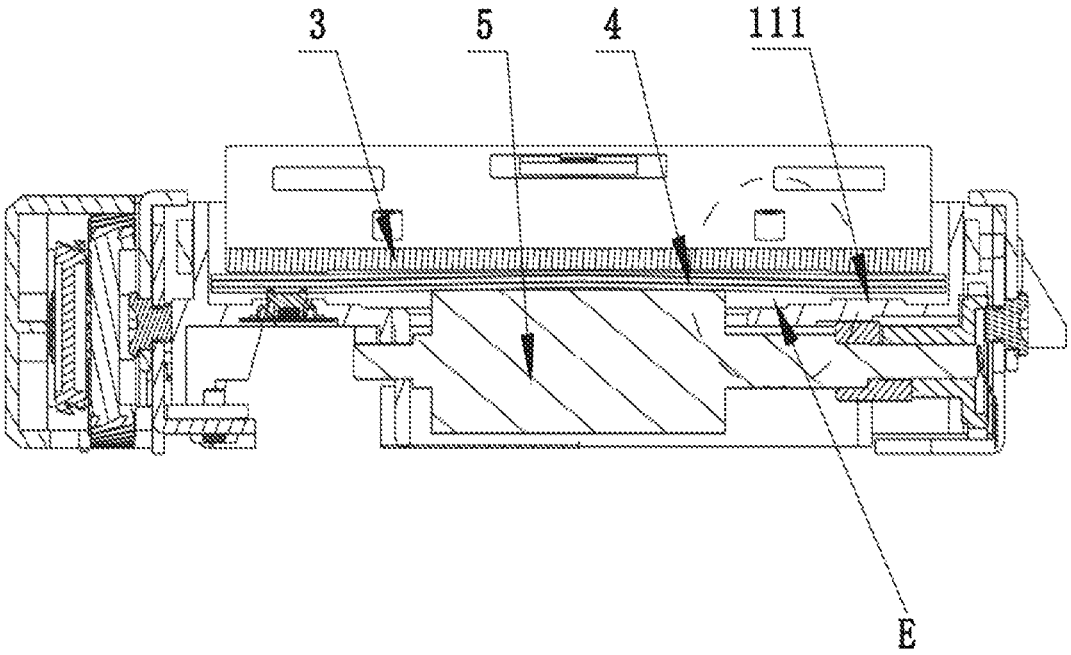
FIG. 8 is a cross-sectional view taken along a line C-C shown in FIG. 1.
Figure 9:
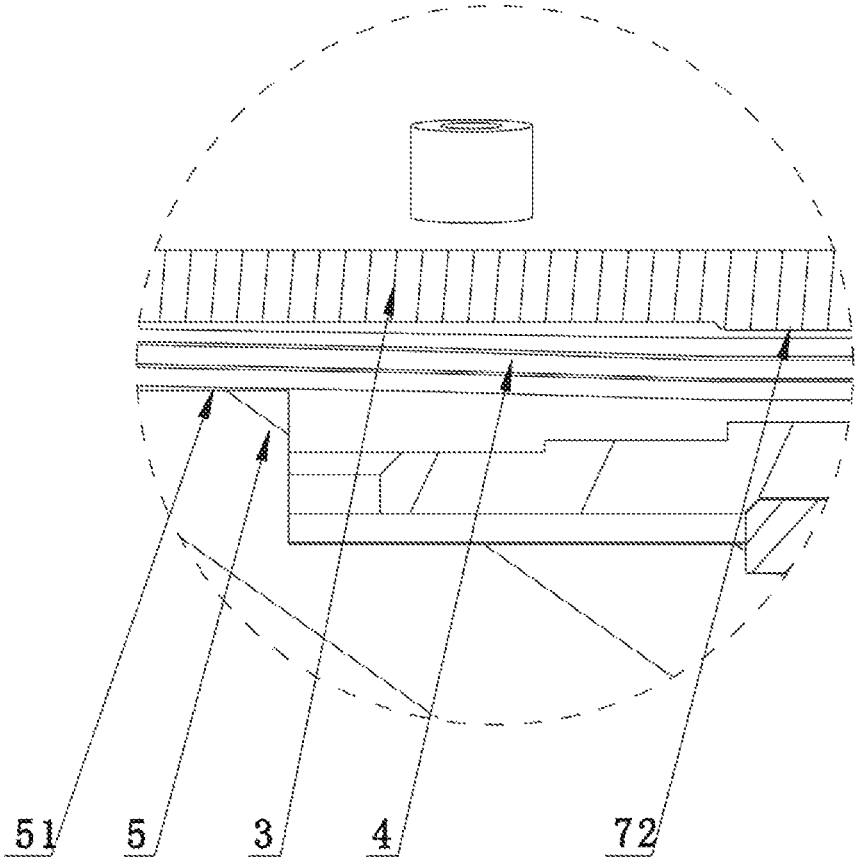
FIG. 9 is an enlarged view schematically showing a part E of FIG. 8.

In particular, referring to FIGS. 8 and 9, the deforming mechanism comprises a supporting portion 51 protruding upwardly from the bottom 111 of the printing paper accommodating cavity such that the middle part of the printing paper sheets 4 can be arched, and a pressing portion 72 for pressing down two edges of the printing paper sheets 4 such that two edges of the printing paper sheets 4 get close to the printing paper accommodating cavity 11. Preferably, the supporting portion 51 may be arranged on the pick-up roller, the pick-up roller 5 protrudes upwardly from the bottom 111 of the printing paper accommodating cavity, and the pressing portion 72 may be arranged at two sides of the front end of the pressing element 3. Due to the downward force applied by the pressing element 3, two edges of the printing paper sheets 4 get close to the bottom 111 of the printing paper accommodating cavity. Since in the middle portion the pick-up roller 5 protrudes from the bottom 111 of the printing paper accommodating cavity, the printing paper sheets 4 can be arched to ensure easy pick-up of the printing paper sheets 4 and facilitate the separation of the printing paper sheets 4.

A leading angle 26 in an arch-like shape may be formed on the middle access portion 23 at a side of the obstruction element 2 which is adjacent to the printing paper accommodating cavity 11. The shape of the leading angle 26 which is in an arch-like shape fits with the shape of the printing paper sheets 4 which have arched middle part. It provides a leading surface for the printing paper sheets 4 which have arched middle part, and the pressing portion 72 presses two edges of the printing paper sheets 4 towards the printing paper accommodating cavity 11. When the pick-up roller 5 performs transmission, the highest point of the arched middle part of the lowest printing paper sheet 4 and the bottom 111 of the printing paper accommodating cavity may be higher than the middle access portion 23 of the obstruction element 2. Due to the leading angle 26 in an arch-like shape, the arched middle part of the lowest printing paper sheet 4 can be gradually flattened during transmission to pass through the obstruction element 2. In this way, it can be prevented from abutting on and being obstructed by the obstruction element. Thus, it avoids the need for greater transmission force and the damage to the printing paper sheets 4 and consequent paper jam.

In order to avoid possible attraction which is caused by the static electricity generated when the printing paper sheets 4 abuts the bottom 111 of the printing paper accommodating cavity and which may result in a failure of feeding the lowest printing paper sheet 4 during the rotation of the pick-up roller, a plurality of supporting strips 112 may be arranged on the bottom 111 of the printing paper accommodating cavity. Wherein the height of the supporting strips 112 may be very small to make sure that the printing paper sheets 4 would not be crumpled. And meanwhile tiny gaps can be formed between the printing paper sheets 4 and each small section of the bottom 111 of the printing paper accommodating cavity to facilitate the feeding of the printing paper sheets 4.

In the present embodiment, the operation method and principle are as follows. Firstly, a determined number of printing paper sheets 4 can be located in the printing paper accommodating cavity 11, and the deforming mechanism abuts on the printing paper sheets 4 due to the pressing element 3. Then, the driving device of the printer can be actuated, such that the pick-up roller 5 can drive the printing paper sheets 4 to perform transmission. The pressing element 3 may apply a pressure force to the printing paper sheets 4 by the deforming mechanism. When the printing paper sheets 4 are transmitted by the pick-up roller 5, the middle part of the printing paper sheets 4 may be arched along the supporting portion 51 of the pick-up roller 5, and at two ends, two edges of the printing paper sheets 4 may get close to the printing paper accommodating cavity 11 due to the pressing portion 72. Since only one printing paper sheet 4 can pass through the gap formed at the blocking portions 24 of the obstruction element 2 at a time, when two or more printing paper sheets 4 are transmitted to the obstruction element 2, the lowest printing paper sheet 4 can be transmitted to pass through the obstruction element 2 due to pressure force and the friction force generated by the pick-up roller 5 during feeding frontward. The arched middle part of the lowest printing paper sheet 4 can be gradually flattened by the leading angle 26 of the obstruction element 2 that in an arch-like shape and transmitted frontward to the printer for printing. After the lowest sheet is transmitted to pass through the obstruction element 2, the second lowest printing paper sheet 4 which abuts against the bottom of the printing paper accommodating cavity 11 due to the pressing element 3 becomes the lowest printing paper sheet 4. It can be continually transmitted frontward to the printer for printing due to pressure force and the friction force generated by the pick-up roller 5 during frontward feeding, and so on. In such a case, it assures that one and only one printing paper sheet 4 can be fed to the printer at a time.

Figure 10:
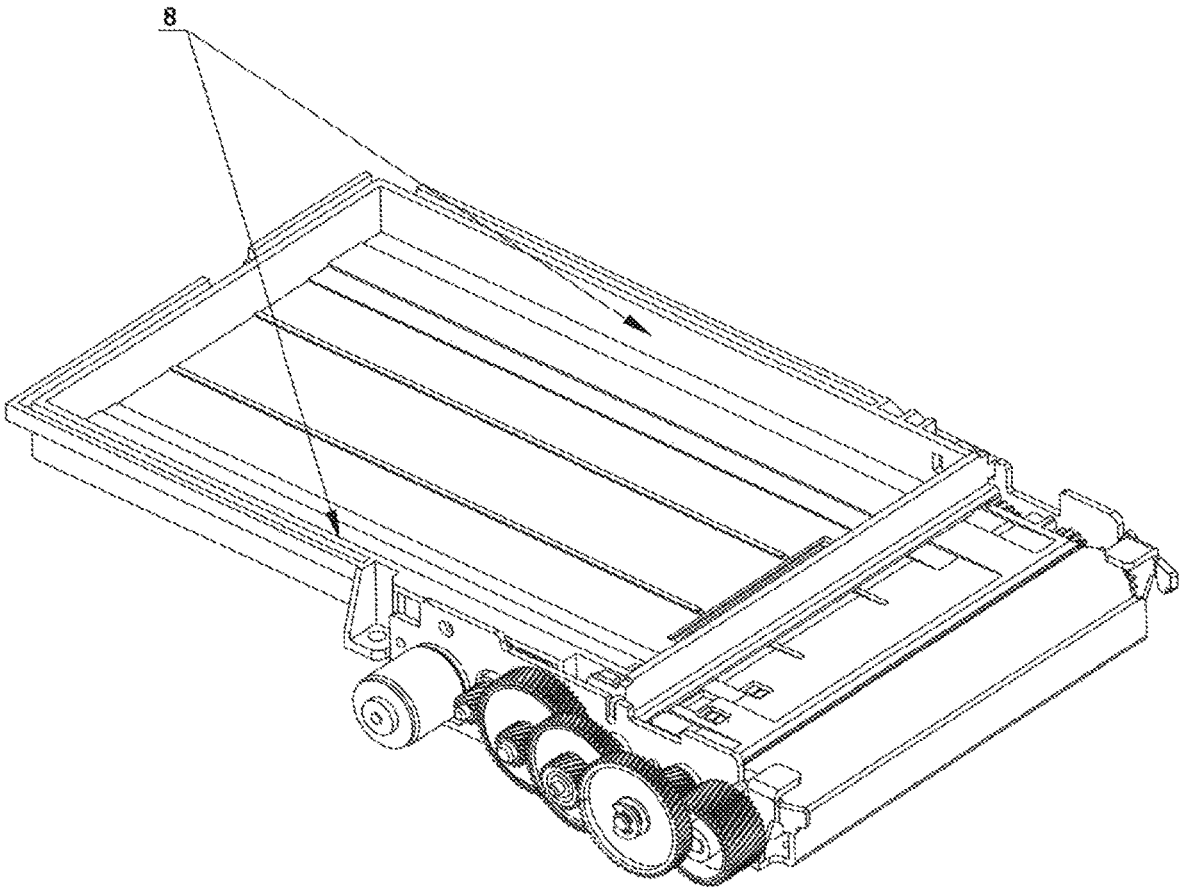
FIG. 10 is a schematic view according to a second embodiment of the present disclosure.
Figure 11:
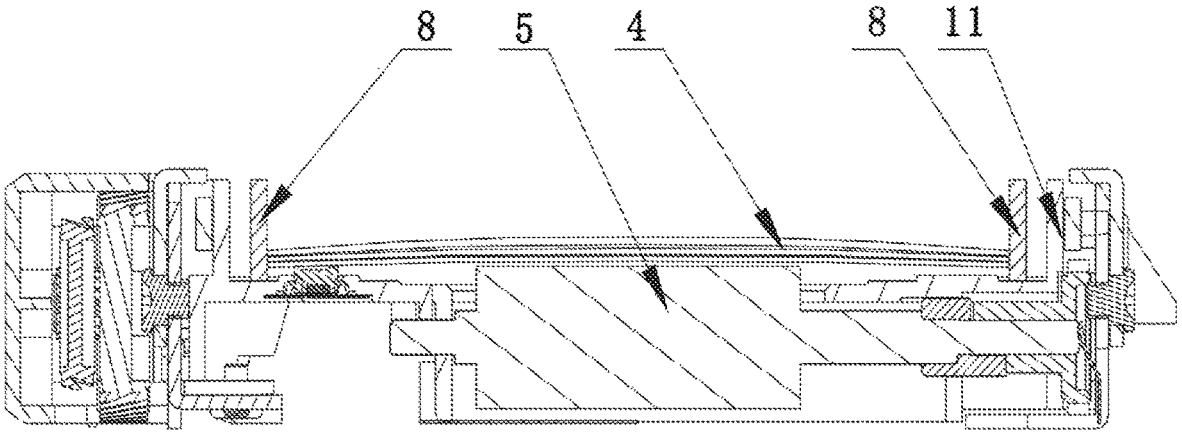
FIG. 11 is a cross-sectional view taken along the line C-C shown in FIG. 1 according to the second embodiment of the present disclosure.

In the second embodiment of the present disclosure, referring to FIGS. 10 and 11, the present embodiment is identical to the first embodiment and the only difference is the deforming mechanism. In the second embodiment, the deforming mechanism comprises two position limiting walls 8 and the pressing element 3 in cooperation with the two position limiting walls 8 to press the printing paper sheets 4 towards the bottom 111 of the printing paper accommodating cavity, and the pressing element 3 press the pressing portion 72 arranged at two sides of the front end in such a manner that two edges of the printing paper sheets 4 tightly abut on the bottom 111 of the printing paper accommodating cavity. The two position limiting walls 8 are arranged in parallel with each other in the printing paper accommodating cavity 11 in such a manner that the distance between the two position limiting walls 8 is less than the width of one paper sheet, such that the middle part of the printing paper sheets 4 disposed in the printing paper accommodating cavity 11 can be arched, thereby ensuring easy pick-up of the printing paper sheets 4 and facilitating the separation of the printing paper sheets 4. In particular, it is conceivable that the two position limiting walls 8 may have one moveable end or two moveable ends, which one moveable end or two moveable ends can be moved, depending on various types of printing paper sheets 4 to be printed, in such a manner that the distance between the two position limiting walls 8 is less than the width of one paper sheet, such that the middle part of the printing paper sheets 4 disposed in the printing paper accommodating cavity 11 can be arched.

Figure 12:
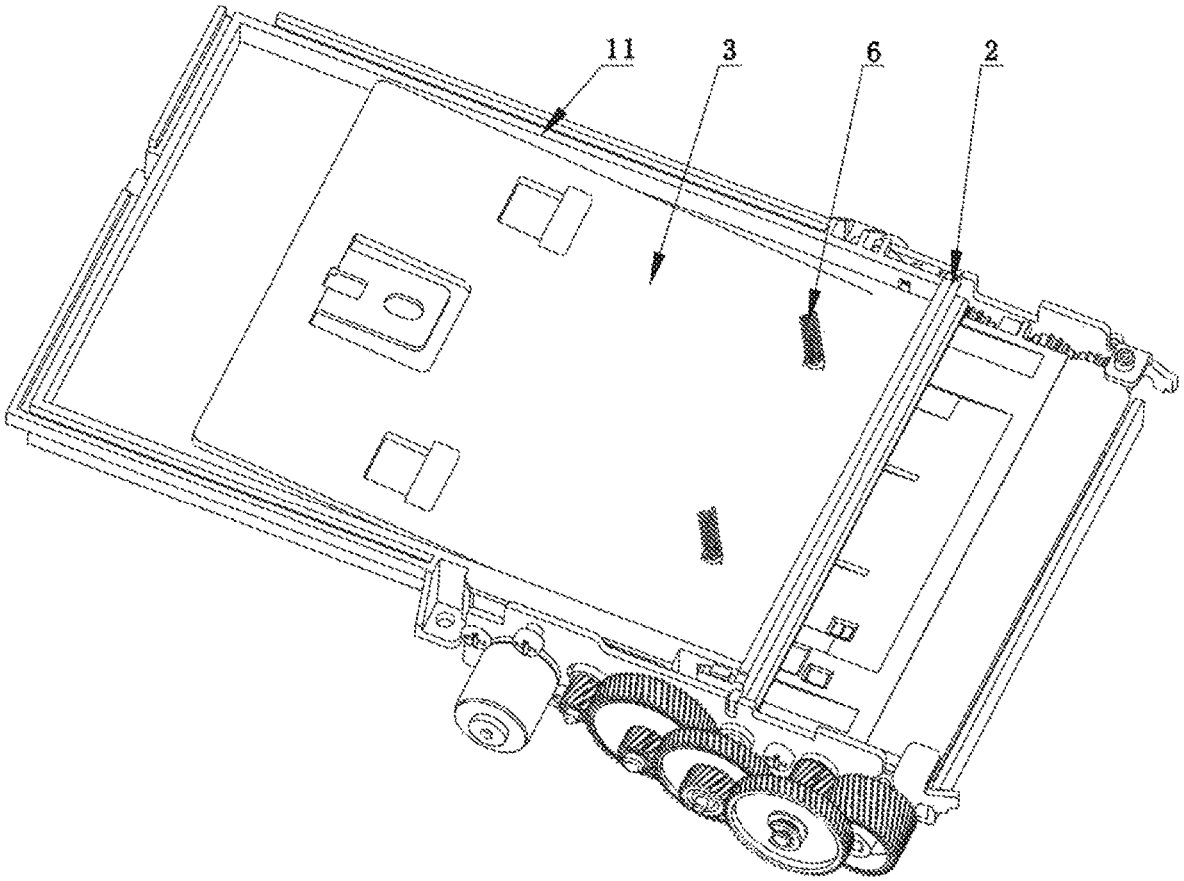
FIG. 12 is a schematic view of a printer according to the present disclosure.

Referring to FIG. 12, the present disclosure further provides a printer, which comprises a housing (not shown in the drawings) and the above mentioned device for separating printing paper sheets, wherein elastic elements 6 configured for pressing the printing paper sheets 4 towards the printing paper accommodating cavity 11 are arranged between the pressing element 3 and the housing. Preferably, the elastic element 6 may be a spring and may have one end fixed to the pressing element 3 and another end fixed to the housing. The housing can apply a pressure force on the pressing element 3 by the elastic element 6, whereby the printing paper sheets 4 can be pressed.

The above are only some embodiments of the present disclosure and are not intended to limit the present disclosure. To those of ordinary skill in the art, various modifications and changes can be made to the present disclosure. Any modifications, equivalent substitutions, improvements, etc. made within the spirit and scope of the present disclosure are intended to be included within the scope of the present disclosure.

What is claimed is:

1. A device for separating printing paper sheets, comprising:

a base part defining a printing paper accommodating cavity, wherein a plurality of supporting strips are arranged on a bottom of the printing paper accommodating cavity;

a deforming mechanism configured for arching a middle part of the printing paper sheets and enabling two edges to get closer to the bottom of the printing paper accommodating cavity, wherein the deforming mechanism comprises a supporting portion protruding upwardly from the bottom of the printing paper accommodating cavity, such that the middle part of the printing paper sheets is capable of being arched; and a pressing portion configured to press down two edges of the printing paper sheets, such that the two edges of the printing paper sheets are able to get closer to the printing paper accommodating cavity;

a pressing element, wherein the pressing portion is respectively provided at two sides of the pressing element to enable sides of the printing paper sheets to get closer to the bottom of the printing paper accommodating cavity, and the pressing portion and the pressing element are integral; and an obstruction element, wherein the obstruction element is provided with a middle access portion in cooperation with the deforming mechanism, and on two sides of the middle access portion is arranged with at least one blocking portion through which only one of the printing paper sheets can pass at a time; both sides of the obstruction element are arranged with an avoidance portion respectively, and between the middle access portion and each one of the avoidance portions are provided with the blocking portions; and the avoidance portions, the middle access portion and blocking portions are integral.

2. The device for separating printing paper sheets according to claim 1, wherein the bottom of the printing paper accommodating cavity is arranged at a middle portion of a front end with a pick-up roller, and the pick-up roller protrudes upwardly from the bottom of the printing paper accommodating cavity and the supporting portion is arranged on the pick-up roller.

3. The device for separating printing paper sheets according to claim 2, wherein the pick-up roller is adapted to be driven by a driving device to feed the printing paper sheets frontward.

4. The device for separating printing paper sheets according to claim 1, wherein the deforming mechanism comprises two position limiting walls and a pressing element in cooperation with the two position limiting walls configured to press the printing paper sheets towards the bottom of the printing paper accommodating cavity; and the two walls are arranged in parallel and spaced at a distance less than a width of one paper sheet.

5. The device for separating printing paper sheets according to claim 1, wherein a leading angle in an arch like shape is formed on the middle access portion at a side of the obstruction element adjacent to the printing paper accommodating cavity.

6. The device for separating printing paper sheets according to claim 1, wherein a leading angle in an arch like shape is formed on the middle access portion at a side of the obstruction element adjacent to the printing paper accommodating cavity.

7. The device for separating printing paper sheets according to claim 2, wherein a leading angle in an arch like shape is formed on the middle access portion at a side of the obstruction element adjacent to the printing paper accommodating cavity.

8. The device for separating printing paper sheets according to claim 3, wherein a leading angle in an arch like shape is formed on the middle access portion at a side of the obstruction element adjacent to the printing paper accommodating cavity.

9. The device for separating printing paper sheets according to claim 1, wherein a leading angle in an arch like shape is formed on the middle access portion at a side of the obstruction element adjacent to the printing paper accommodating cavity.

10. The device for separating printing paper sheets according to claim 4, wherein a leading angle in an arch like shape is formed on the middle access portion at a side of the obstruction element adjacent to the printing paper accommodating cavity.

11. A printer, comprising a housing, and the device of claim 1.

12. The printer according to claim 11, further comprising an elastic element configured to press the printing paper sheets towards the printing paper accommodating cavity, the elastic element is arranged between the pressing element and the housing.

13. The printer according to claim 1, wherein two lengthened supporting plates are respectively arranged at the two sides of the obstruction element, the lengthened supporting plates are configured to engage with grooves of the base part to restrain frontward and rearward movements of the obstruction element; and the obstruction element is further arranged at two ends with extending portions extending frontward, and the extending portions are respectively arranged with a fixing element, which is able to engage with openings provided on sidewall of the printing paper accommodating cavity in order to fix the obstruction element on the base part.

* * * * *